United States Patent [19]

Lacombe

[11] 4,080,482

[45] Mar. 21, 1978

[54] SPACER FOR GLASS SEALED UNIT AND INTERLOCK MEMBER THEREFOR

[75] Inventor: Gaetan Y. Lacombe, Duvernay, Canada

[73] Assignee: D. C. Glass Limited, Anjou, Canada

[21] Appl. No.: 630,772

[22] Filed: Nov. 11, 1975

[51] Int. Cl.[2] ..... E06B 3/24; E06B 7/12

[52] U.S. Cl. ..... 428/34; 52/172; 52/304; 52/616; 52/620; 52/656; 52/658

[58] Field of Search ..... 428/34; 52/172, 616, 52/620, 304, 308, 398, 399, 656, 658

[56] References Cited

U.S. PATENT DOCUMENTS

| | | | |
|---|---|---|---|
| 2,974,377 | 3/1961 | Kunkle | 52/172 |
| 3,030,673 | 4/1962 | London | 52/616 |
| 3,114,179 | 12/1963 | Briggs | 52/616 |
| 3,280,523 | 10/1966 | Stroud | 52/616 |
| 3,345,791 | 10/1967 | Shinefeld | 52/616 |
| 3,791,910 | 2/1974 | Bowser | 428/34 |
| 3,852,149 | 12/1974 | Sitter | 428/34 |
| 3,919,821 | 11/1975 | Goetz | 52/616 |
| 3,928,953 | 12/1975 | Mazzoni | 52/172 |

FOREIGN PATENT DOCUMENTS

| | | | |
|---|---|---|---|
| 953,159 | 8/1974 | Canada | 428/34 |
| 628,314 | 11/1964 | Italy | 52/616 |

*Primary Examiner*—Ellis Robinson
*Attorney, Agent, or Firm*—Roland L. Morneau

[57] ABSTRACT

A spacer for a glass sealed unit being characterized by an inner wall having a slit along the median line, both sides of the slit being formed by a fold having their apex adjacent to one another, two lateral walls adjacent the outer wall of the spacer forming a recess relative to the remaining lateral sides of the spacer, an interlock member for connecting two ends of two spacers at right angle, the interlock member has two legs disposed at right angle, each leg has a U-shaped cross-section, each leg penetrating inside each adjacent end of the spacers so that the base of the U-shaped cross-section lies between the lateral walls of the spacer and the free edges of the sides of the U-shaped cross-section lie outside the free edges of the folds.

8 Claims, 4 Drawing Figures

SPACER FOR GLASS SEALED UNIT AND INTERLOCK MEMBER THEREFOR

The present invention is directed to a spacer for glass sealed unit and to the combination of spacers and interlock members for such a unit.

Sealed units are particularly known for windows in which a pair of glass panes are separated by an air space. This space is maintained by spacers disposed around the edge of the glass panes. In order to be effective, the spacer must seal the air trapped between the glass panes. This is usually accomplished by sealants disposed between the spacer and the glass. Furthermore, the air trapped must be moisture-free. The moisture is eliminated by a desiccant inside the spacer, the latter being provided with openings.

Four spacers are used to follow the contour of the window, that is, one spacer on each side. The spacers are fixed to each other by welding. The welding is an ackward process for connecting tubular members of the size and shape of the spacers used in the present invention. It requires welding devices and welding expertise for this purpose only, during the whole assembly of the window components. It requires a precise angular cutting of the ends of the spacers for forming a right angular frame.

According to the invention, the spacers are mechanically connected to each other by an interlocking member.

With such interlocking member, the ends of the spacers can remain square and no special step is required for angularly cutting the ends.

Furthermore, according to the invention, the spacer is particularly shaped so as to produce a solid and sufficiently tight connection between two spacers.

The spacer, also according to the invention, is provided with a special type of slot for the desiccant to demoisturize the air between the glass panes. The space of the slot will be maintained by a particular shaping arrangement between the spacer and the interlocking member.

An additional characteristic of the invention consists in providing the spacer with walls which will increase the lateral support of the interlock member.

Figure 1:
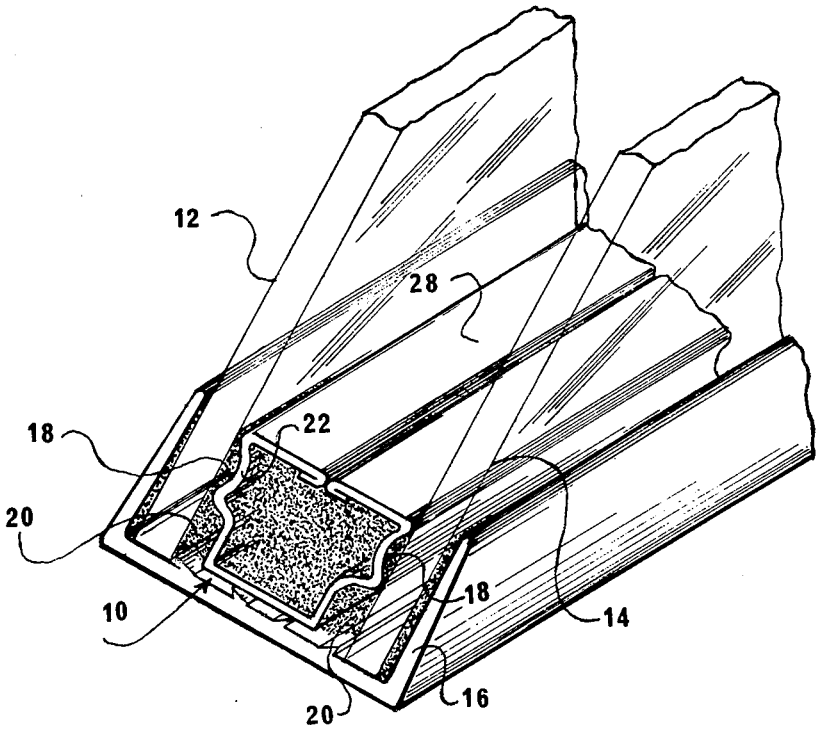
Figure 2:
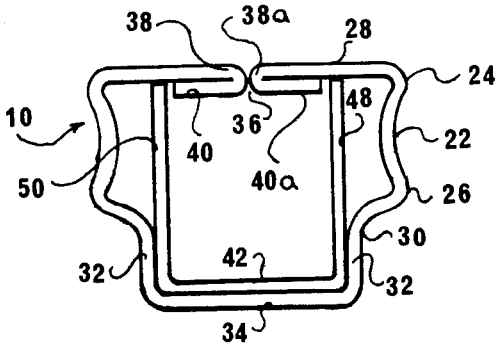
Figure 3:
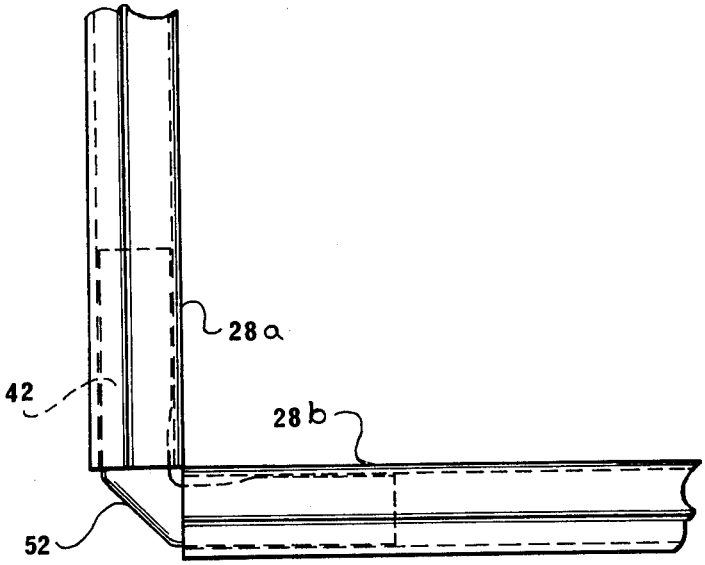
Figure 4:
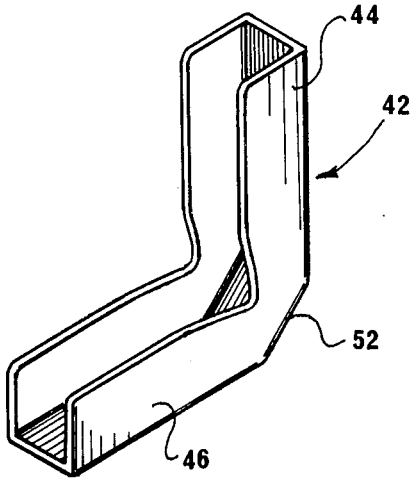

The invention will now be described in greater details by referring to drawings wherein;

FIG. 1 is a perspective view of the edge of a glass sealed unit seen at a cross-section thereof, FIG. 2 is a cross-sectional view of a spacer and an interlock member according to the invention, FIG. 3 is a side view of two spacers connected by an interlock member, and FIG. 4 is a perspective view of an interlock.

Glass sealed units for windows, doors or the like, comprises many problems which must be solved with particular structures materials and combination thereof. As the same implies, the glass must be well sealed so as to prevent any leakage of air so that the air which is trapped between the two glass panes may remain moisture-free. In the arrangement contemplated by the applicant, a slot which opens in the air space between the glass panes is contemplated. This slot is in the order of 0.002 inch. Such a narrow slot, when it varies in dimension, due to the thermal variation, will cause the two adjoining edges to abut against each other and to cause sharp clicking noise when they snap against each other.

Another problem which is encountered when the two glass panes are placed one against the other is that the air trapped in between causes the spacers to curve outwardly due to the air which tries to escape. Accordingly, the spacers must be strong enough to resist such a pressure. According to the invention, parts of the lateral walls of the spacers are substantially parallel to the direction of this pressure.

An important part of this invention is to provide a new means for connecting adjoining ends of spacers at the corner of the sealed units in order to prevent the need for welding. An interlocking member which can slide inside the ends of two adjoining spacers and which can offer the required rigidity is contemplated. According to the present invention, the interlocking member is shaped so as to have good lateral support inside the spacers and furthermore, so as to offer a resistance to the movement of the adjoining edges of the spacer which constitute the slot.

Another generic aspect of the invention is to provide the spacer with an outer contour so as to allow a sufficient amount of sealant between itself and the glass panes. This particular combination between the amount of sealant and the shape of the spacer is particularly useful when used in combination with a covering channel as disclosed in copending U.S. application, Ser. No. 630,771 simultaneously filed by the same inventor.

FIGS. 1 and 2 show a spacer 10 according to the present invention mounted between two glass panes 12 and 14 and protected by a cover 16. The sealing between the two panes 12 and 14 is provided by a butyl sealant 18 and a polysulphide sealant 20. The butyl sealant 18 is located in the groove 22 located between two beaded strips 24 and 26 adjacent the inner wall 28. The polysulphide sealant 20 is disposed in the recess 30 which is formed by the wall 32 which is adjacent and substantially perpendicular to the outer wall 34. The inner wall 28 is split in the middle and forms a slot 36. The material on each side of the slot is folded backward to form a U-shape. The apex of each fold are near each other and form a slot 36 of few thousandths of an inch and preferably about two thousandths of an inch.

The folds 38 and **38*a*** are U-shaped in that the material of the spacer is preferably bent over itself and have an outer round contour so that when they abut against each other, they can slide smoothly if the pressure is too great. Although the outer contour is preferably round, large flat contour could also be considered within the embodiment of this invention.

The free edges 40 and **40*a* of the folds 38 and 38*a* are bent inwardly of the spacer and are maintained at a distance so as to be limited by the interlocking member 42**.

The spacer 10 is provided along the outer surface with two substantially parallel walls 32 substantially perpendicular to the outer wall 34. These walls 32 are distant from each other so as to constitute a lateral support for the interlocking member 42. Furthermore, the height of these walls extends over a good part of the height of the spacer in order to accommodate a large quantity of polysulphide sealant 20.

The parallel walls 32 have also the advantage of providing a strong rigidity to the spacer against bending when the air becomes trapped between the two glass panes 12 and 14.

As indicated above, a part of the function of the shape of the new spacer is directed to receive an interlock member at the end for connecting two perpendicularly disposed spacers. As shown in FIG. 4, the interlock has two legs 44 and 46 disposed at a right angle, each leg having a U-shaped cross-section. The length of each leg must be long enough to provide the required rigidity between the two interconnected spacers. In practice, the length of such legs is about one inch long. Each side 48 and 50 of the interlocking member 42 extends from the inner surface of the outer wall 34 up until the inner surface of the inner wall 28. However, the height of these sides 48 and 50 is reduced along their free edges adjacent the right-hand corner of the interlock member. This reduction in height of the sides 48 and 50 is intended so as to allow a better contact of the inner wall 28*a* and 28*b* as shown in FIG. 3 when the two spacers are mounted over the interlocking member 42. This good contact between the two inner walls 28*a* and 28*b* is important to maintain the air well trapped between the glass panes 12 and 14 and to maintain the sealant 18 and 20 away from the visible part of the spacer when seen through the glass panes 12 and 14.

Another preferred characteristic of the interlocking member 42, consists in that the base of the U-shaped cross-section of the legs 44 and 46 is disposed at 45° at the right-hand corner of the interlock member to form a wall 52. The purpose of the inclined wall 52 is to allow a good quantity of sealant to penetrate around the corners of the window so that a good seal will be obtained and so that the sealant will retain the cover 16.

The distance between the free edges of the sides 48 and 50 of the interlock member slightly exceeds the distance between the free edges of the folds 40 and 40*a*. With this arrangement, the free edges 40 and 40*a* of the folds will be used as guides for the free edges of the sides 48 and 50 and also to constitute a support for the latter. With this arrangement, the interlock member 42 will be held at its base between the lateral walls 32 and at its top by the free edges 40 and 40*a* of the folds. Furthermore, the free edges of the sides 48 and 50 will prevent the folds 38 and 38*a* to spread out. According to a precise embodiment of the invention, a spacer has a total height of 0.310 inch, a total width of 0.425 inch and a material thickness of 0.0187 inch. The distance between the two lateral walls 32 is 0.295 inch and the height of the lateral walls 32 is about 0.118 inch. The distance between the free edges 40 and 40*a* of the folds is about 0.09 inch. The width of the interlock member 42 is dimensioned so as to frictionally engage between the two lateral walls 32 and its maximum height to frictionally engage between the inner wall 28 and the outer wall 34.

Although the present invention has been described for specific embodiments, it should be obvious that modifications may be made without departing from the scope of the following claims.

What I claim is:

1. A spacer for a glass sealed unit comprising a hollow tubular member having an inner and an outer wall and two similar sidewalls, the outer surface of each sidewall having a longitudinal groove between two beaded strips projecting substantially equally outwardly of the bottom of the groove, one of said strips being located along the inner wall, the remaining portion of each of said sidewalls comprising a recess extending between the other of said strips and the outer wall and being substantially perpendicular to the said outer wall, the inner wall being split along a median line to form a slot, the said slot being constituted by the said inner wall being folded, on each side of the split in a U-shaped fold, the apex of each fold being near each other to form a slot of a few thousandths of an inch, the free edge of each of said folds being inside the tubular member and at a space slightly less than the distance between the said remaining portion of the sidewalls.

2. A spacer as recited in claim 1, wherein the apex of the folds has a rounded cross-section.

3. A glass sealed unit comprising a pair of spaced panes of glass, a spacer located between the edges of said panes for maintaining the said panes of glass in a spaced relationship, the said spacer being characterized by a hollow tubular member having an inner and an outer wall and two similar sidewalls, the outer surface of each sidewall having a longitudinal groove between two beaded strips projecting substantially equally outwardly of the bottom of the groove, one of said strips being located along the inner wall, the remaining portion of each of said sidewalls forming a recess extending between the other of said strips and the outer wall and being substantially perpendicular to the said outer wall, the inner wall being split along a median line to form a slot, the said slot being constituted by the said inner wall being folded, on each side of the split in a U-shaped fold, the apex of each fold being near each other to form a slot of a few thousandths of an inch the free edge of each of said folds being inside the tubular member and at a space slightly less than the distance between the said remaining portion of the sidewalls, a butyl sealant located in said groove, a polysulphur sealant located in said recess, and a U-shaped cover for surrounding the said panes and for holding the two panes of glass against the spacer.

4. A sealed unit as recited in claim 3, wherein the pane is a rectangular pane and the said spacer comprises four spacer segments, each segment along each edge of the pane disposed at 90° from one another, one end of one spacer element being adjacent one end of the other spacer element so that the inner wall of the said one end of each spacer element contacts each other, an interlock member for connecting the spacer elements, the said interlock member has two legs disposed at right angle, each leg has a U-shaped cross-section, each leg penetrating inside each adjacent end of the spacer elements so that the base of the said U-shaped cross-section lies on the said outer wall of the spacer element and the free edge of the sides of the said U-shaped cross-section at least partly contact the said inner wall.

5. A sealed unit as recited in claim 4, wherein the distance between the free edge of the sides of the said U-shaped cross-section of the interlock member slightly exceeds the distance between the free edge of the said folds of the tubular member, so as to prevent the spacing of the folds to exceed a predetermined distance.

6. A sealed unit as recited in claim 5, wherein the base of the U-shaped cross-section at the right-hand corner of the interlock member is disposed at about 45° relative to the two legs.

7. A sealed unit as recited in claim 6, wherein the sidewalls of the U-shaped channel have a reduced height adjacent the right-hand corner of the interlock member.

8. A sealed unit as recited in claim 3, wherein a desiccant is located inside the hollow tubular member.

* * * * *